US009033854B1

(12) United States Patent
Butkovic

(10) Patent No.: US 9,033,854 B1
(45) Date of Patent: May 19, 2015

(54) FOREARM EXERCISE APPARATUS

(71) Applicant: Ivan Butkovic, Astoria, NY (US)

(72) Inventor: Ivan Butkovic, Astoria, NY (US)

( * ) Notice: Subject to any disclaimer, the term of this patent is extended or adjusted under 35 U.S.C. 154(b) by 242 days.

(21) Appl. No.: 13/908,314

(22) Filed: Jun. 3, 2013

(51) Int. Cl.
*A63B 21/078* (2006.01)

(52) U.S. Cl.
CPC ..... *A63B 21/078* (2013.01)

(58) Field of Classification Search
CPC .... A63B 2208/00–2208/14; A63B 2208/0257; A63B 21/1457
See application file for complete search history.

(56) References Cited

U.S. PATENT DOCUMENTS 1,171,713 A * 2/1916 Gilkerson ..... 606/245
3,450,132 A 6/1969 Ragon et al.
4,915,377 A * 4/1990 Malnke et al. ..... 482/98
5,180,354 A 1/1993 Jones
5,447,481 A 9/1995 Emter, Jr.
5,613,927 A 3/1997 Rothacker
7,285,077 B1 10/2007 Marx
D578,173 S 10/2008 James

OTHER PUBLICATIONS

Adjustable Forearm Bench, www.befit.ca/products/Adjustable-Formarm-Bench.html, Copyright 2013, (3 pages, enclosed), Last visited Jun. 3, 2013.
Forearm Bench, undated, (1 page, enclosed), Last visited Jun. 3, 2013.
Forearm Bench, www.profitnessusa.com, 1 page, enclosed), Last visited Jun. 3, 2013.

* cited by examiner

*Primary Examiner* — Loan H Thanh
*Assistant Examiner* — Rae Fischer
(74) *Attorney, Agent, or Firm* — Collard & Roe, P.C.

(57) ABSTRACT

A forearm exercise apparatus includes a frame having a pair of rear vertical support legs and a pair of front vertical support legs with upper longitudinal bars coupling the respective rear and front vertical support legs. A seat platform is disposed over the upper longitudinal bars and a pair of pivoting forearm support platforms is disposed in front of the seat platform. The pivoting forearm support platforms have sleeves disposed on an underside thereof. An angle of the forearm support platforms relative to a horizontal plane of the apparatus is adjustable by rotating the respective sleeve around the respective upper longitudinal bar.

10 Claims, 10 Drawing Sheets

FOREARM EXERCISE APPARATUS

BACKGROUND OF THE INVENTION

1. Field of the Invention

The present invention relates to exercising devices. More particularly, the invention relates to a forearm exercise apparatus for exercising a user's forearms, for example the flexor and extensor muscles of the forearms.

2. The Prior Art

A number of devices for exercising the forearm are known. Some of these devices, however, incorporate rather complicated mechanisms such as gears and the like, as for example that described in U.S. Pat. No. 3,450,132. Furthermore, the known devices generally do not develop muscles on both the inside and outside of the forearm.

Accordingly, there exists a need for a forearm exercise apparatus comprising a rather simple and straightforward device for exercising the forearms. Moreover, there exists a need for such an apparatus wherein an angle of a pair of forearm support platforms may be adjusted in order to develop the muscles on both the inside and outside of the forearm.

SUMMARY OF THE INVENTION

The invention relates to exercising devices. More particularly, the invention relates to a forearm exercise apparatus for exercising a user's forearms, for example the flexor and extensor muscles of the forearms.

A forearm exercise apparatus according to an aspect of the invention includes a frame including a first rear vertical support leg, a second rear vertical support leg, a first front vertical support leg, a second front vertical support leg, a first upper longitudinal bar coupling the first rear vertical support leg to the first front vertical support leg and a second upper longitudinal bar coupling the second rear vertical support leg to the second front vertical support leg. A seat platform is disposed over the first upper longitudinal bar and the second upper longitudinal bar and a pair of pivoting forearm support platforms is disposed in front of the seat platform. The pair of pivoting forearm support platforms include a first forearm support platform having a first sleeve disposed on its underside, wherein the first upper longitudinal bar passes through the first sleeve and a second forearm support platform having a second sleeve disposed on its underside, wherein the second upper longitudinal bar passes through the second sleeve.

In a forearm exercise apparatus according to an aspect of the invention, an angle of the first forearm support platform relative to a horizontal plane of the apparatus is adjustable by rotating the first sleeve around the first upper longitudinal bar. Likewise, an angle of the second forearm support platform relative to the horizontal plane of the apparatus is adjustable by rotating the second sleeve around the second upper longitudinal bar.

An advantage of a forearm exercise apparatus according to an aspect of the invention is that a pair of forearm support platforms is provided wherein the forearm support platforms are adjustable from a raised position to a lowered position which allows a user to develop forearm muscles on both sides of the forearm. In particular, when the forearm support platforms according to an aspect of the invention are in a raised position, the outside extensor forearm muscles are developed. When the forearm support platforms according to an aspect of the invention are in a lowered position, the inside flexor forearm muscles are developed.

A further advantage of a forearm exercise apparatus according to an aspect of the invention is that an exercise apparatus is provided which allows a user to develop the forearm muscles without injuring or damaging the wrist, which is subject to great pressure and strain during a forearm development exercise. A further advantage of a forearm exercise apparatus according to an aspect of the invention is that an exercise apparatus is provided wherein the forearm support platforms can be adjusted to an exact angle of natural wrist movement.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
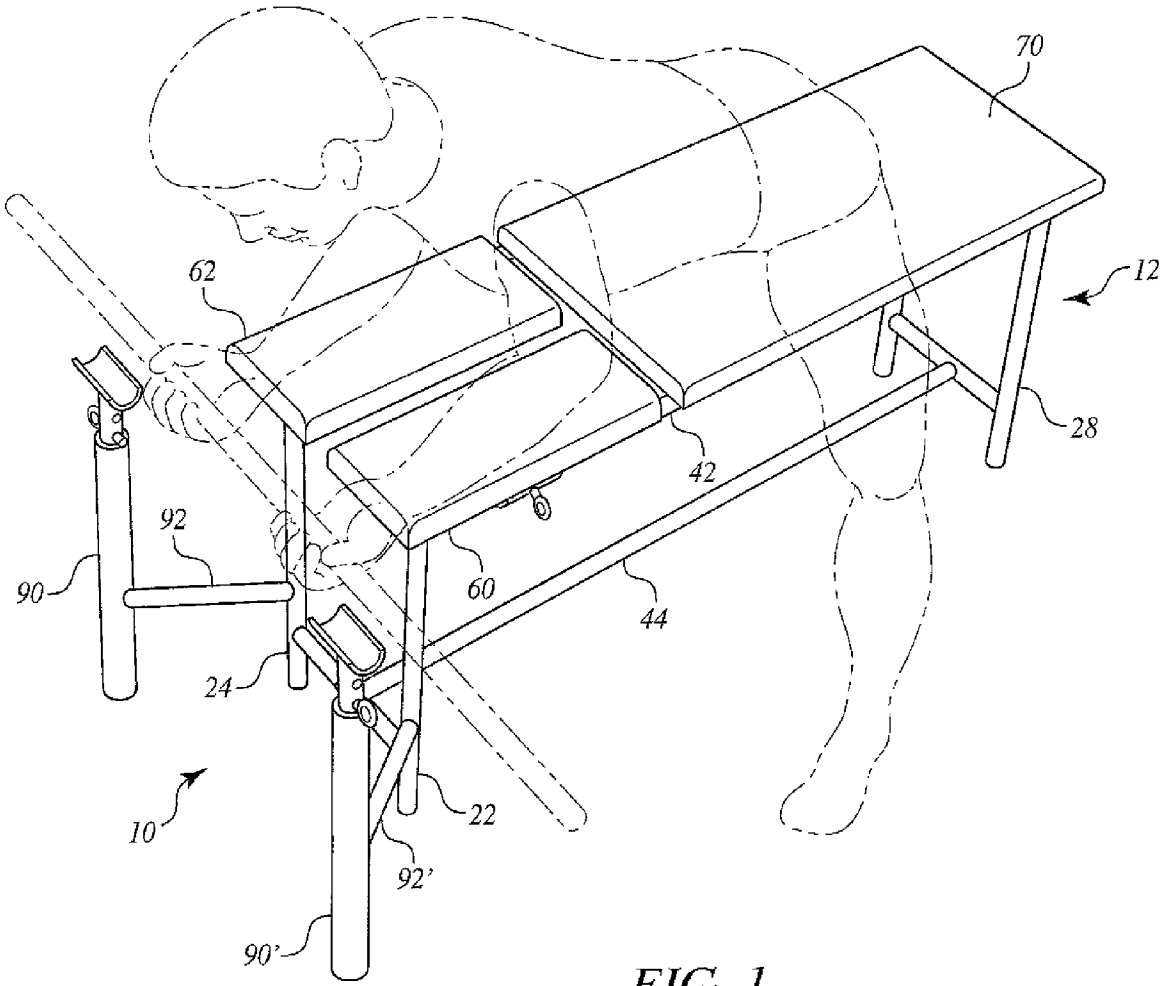
FIG. 1 shows a perspective view of a forearm exercise apparatus according to an embodiment of the invention.
Figure 2:
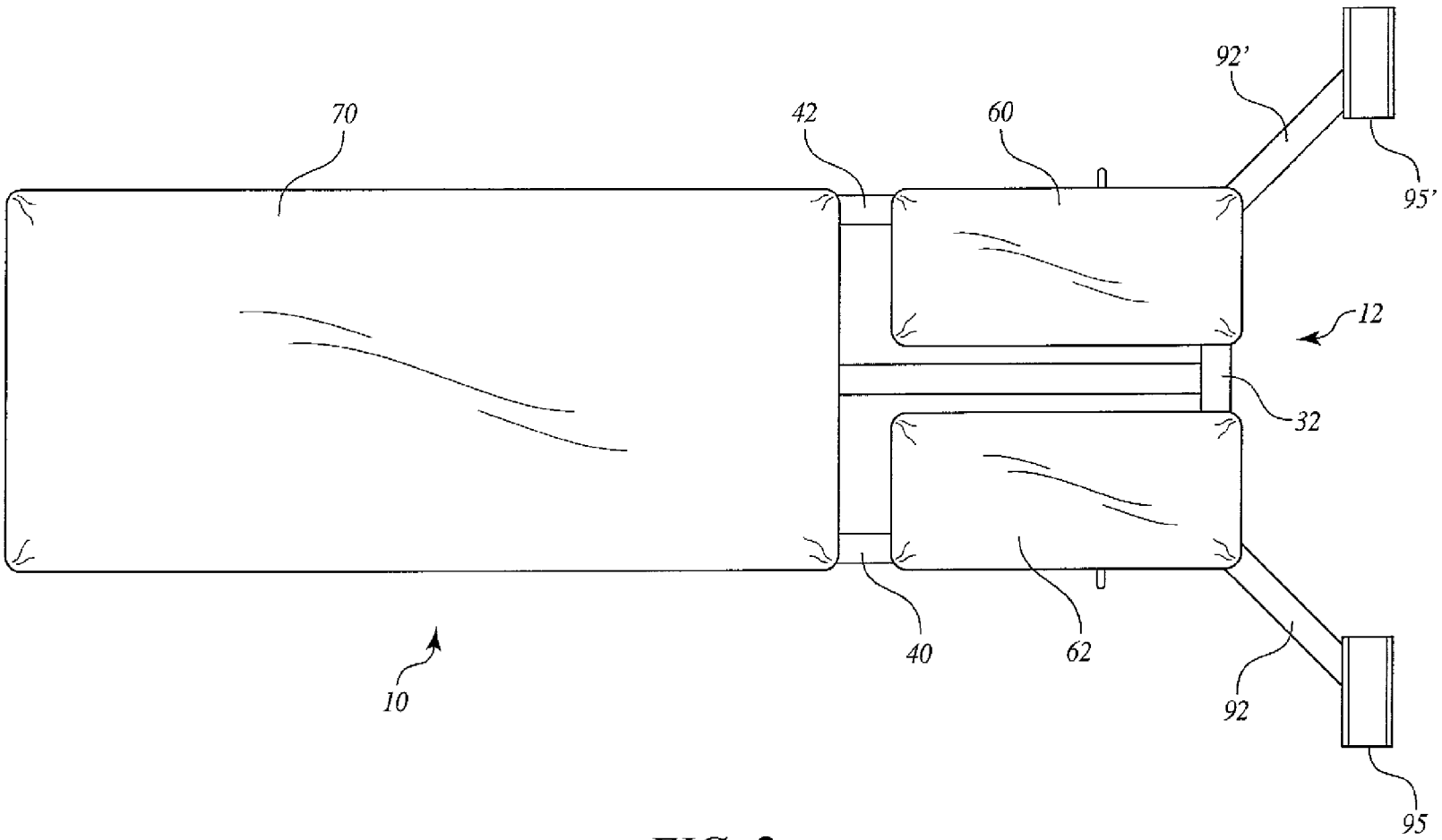
FIG. 2 is a top plan view of the forearm exercising apparatus.
Figure 3:
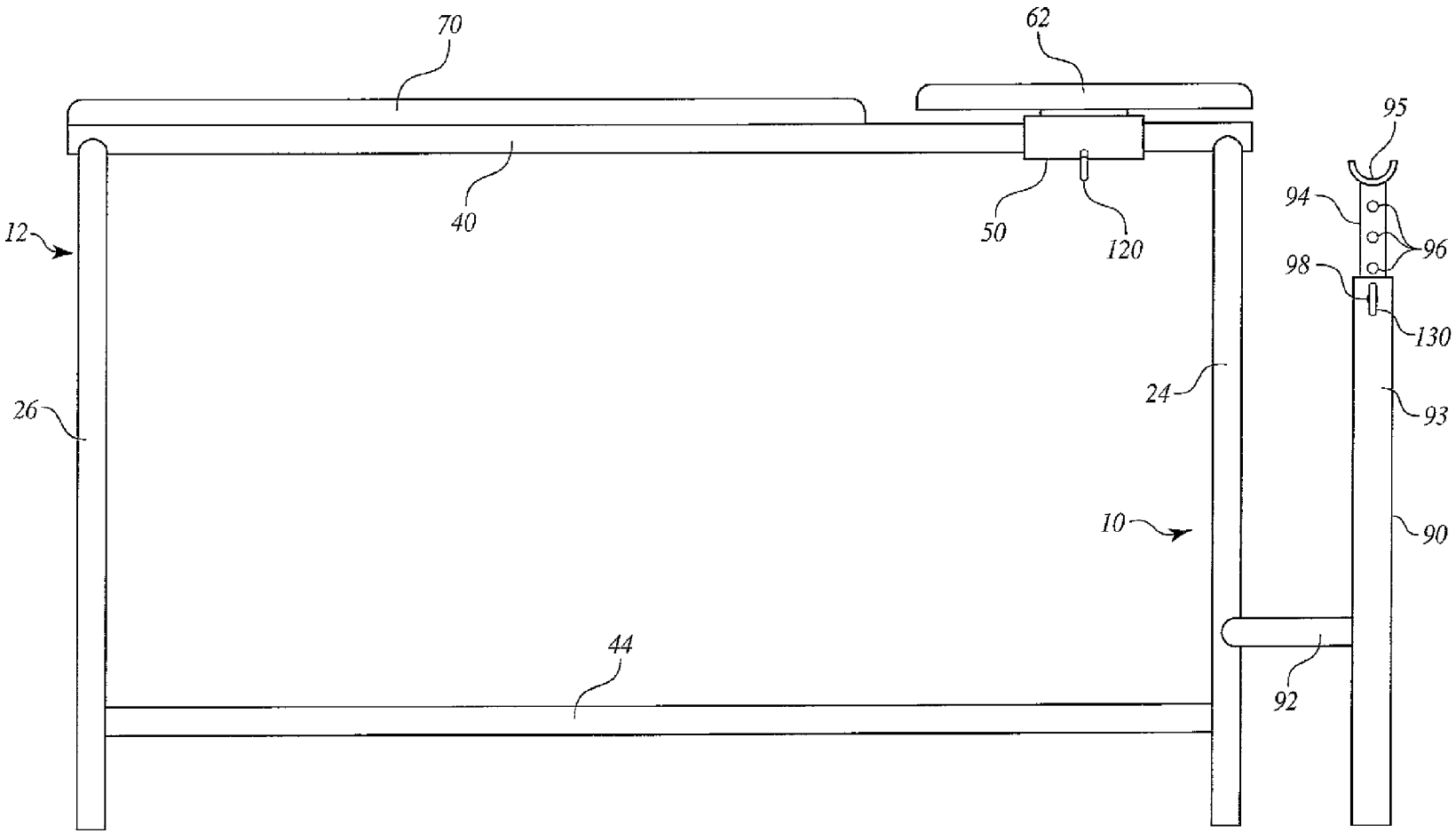
FIG. 3 is a right side elevational view, not to scale, thereof, the left side being a mirror image thereof.
Figure 4:
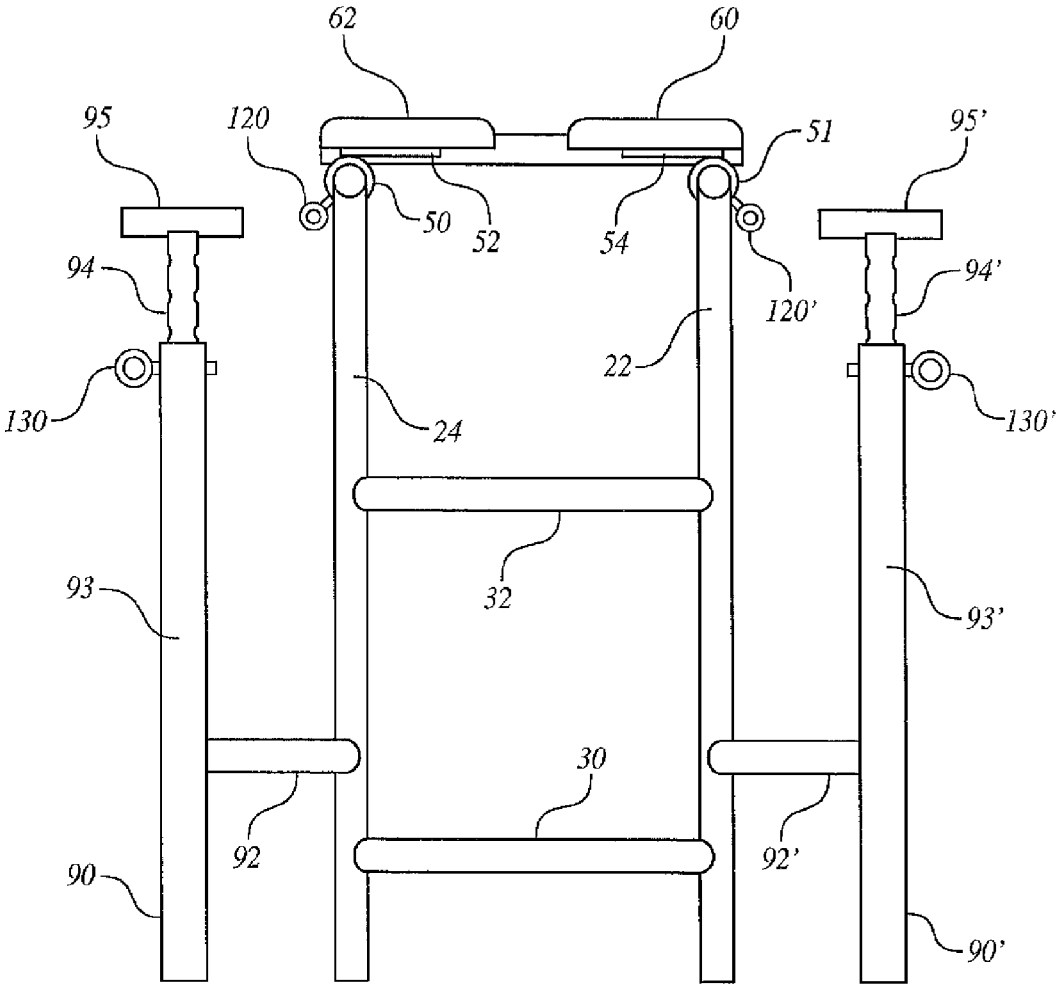
FIG. 4 is a front elevational view, not to scale, thereof.
Figure 14:
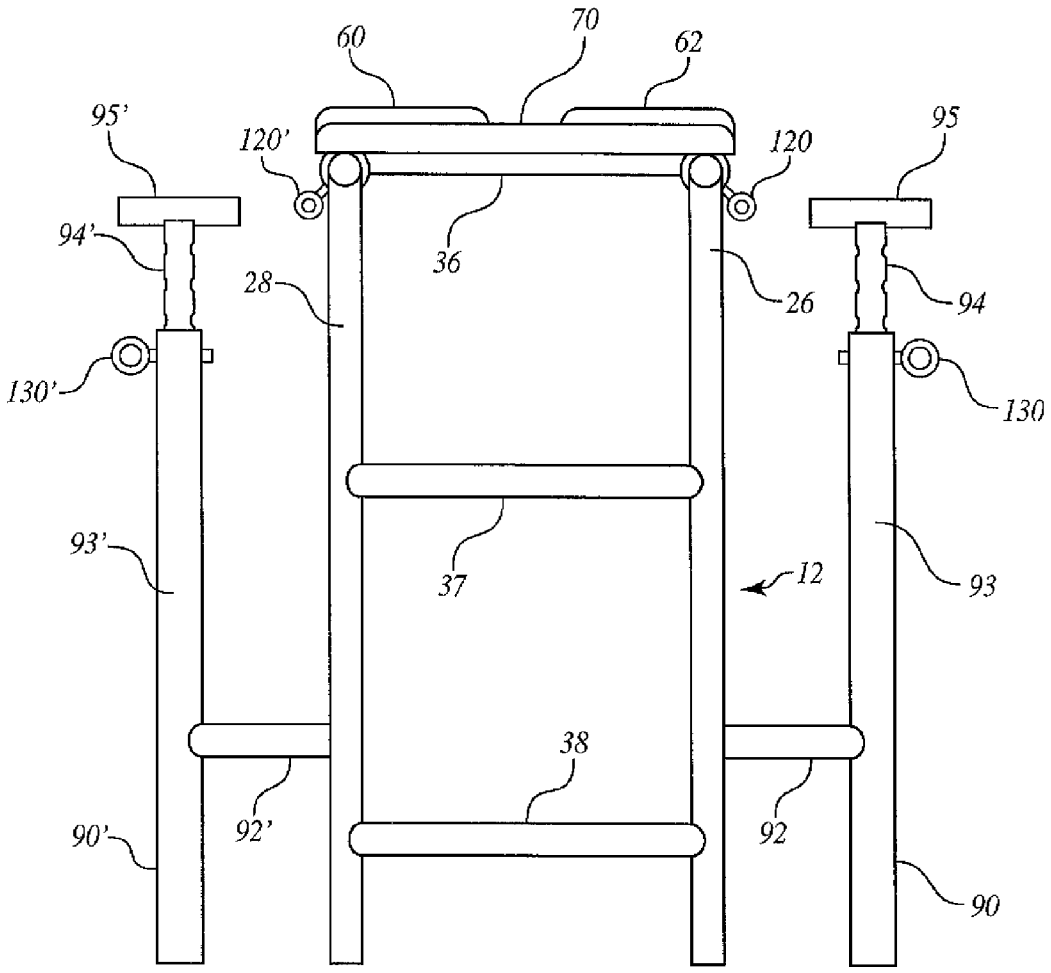
FIG. 14 is a rear elevational view of the forearm exercising device.

Referring now in detail to the drawings and, in particular, FIG. 1 shows a perspective view of a forearm exercise apparatus 10 according to an embodiment of the invention. The forearm exercise 10 apparatus includes a frame or base 12 having a first rear vertical support leg 26, a second rear vertical support leg 28, a first front vertical support leg 24 and a second front vertical support leg 22. As shown in FIG. 4, cross bars 30, 32 may join the two front vertical support legs 22, 24. Rear vertical support legs 26, 28 likewise may be joined by cross bars. For example, as shown in FIG. 14, rear vertical support legs 26, 28 may be joined by three cross bars 36, 37, 38.

A first upper longitudinal bar 40 couples or joins the first rear vertical support leg 26 to the first front vertical support leg 24. Likewise, a second upper longitudinal bar 42 couples or joins the second rear vertical support leg 28 to the second front vertical support leg 22.

A seat platform 70 is located at the rear of the frame 12. A user may sit on the seat platform 70 which can accept the user's buttocks. The seat platform 70 is disposed over the first upper longitudinal bar 40 and second upper longitudinal bar 42 and may be fixedly mounted on or to frame 12. Seat platform 70 may be dimensioned to be longer than it is wide and may be padded to provide a more comfortable support surface.

A pair of pivoting forearm support platforms 60, 62 are disposed in front of seat platform 70 and include a first forearm support platform 62 and a second forearm support platform 60. Forearm support platforms may be disposed side by side in a substantially parallel, spaced apart arrangement. The forearm support platforms 60, 62 may extend beyond the front of or overlap frame 12, more particularly they may extend in front of or overlap front vertical support legs 22, 24 and in front of cross bars 30, 32. The forearm support platforms may be padded to provide a more comfortable support surface First forearm support platform 62 includes a first sleeve 50 disposed on an underside 66 of the first forearm support platform 62 wherein the first upper longitudinal bar 40 passes through first sleeve 50, as shown for example in FIG. 7. Likewise, second forearm support platform 60 includes a second sleeve 51 disposed on an underside 68 of the second forearm support platform 60 wherein the second upper longitudinal bar 42 passes through second sleeve 51.

Figure 8:
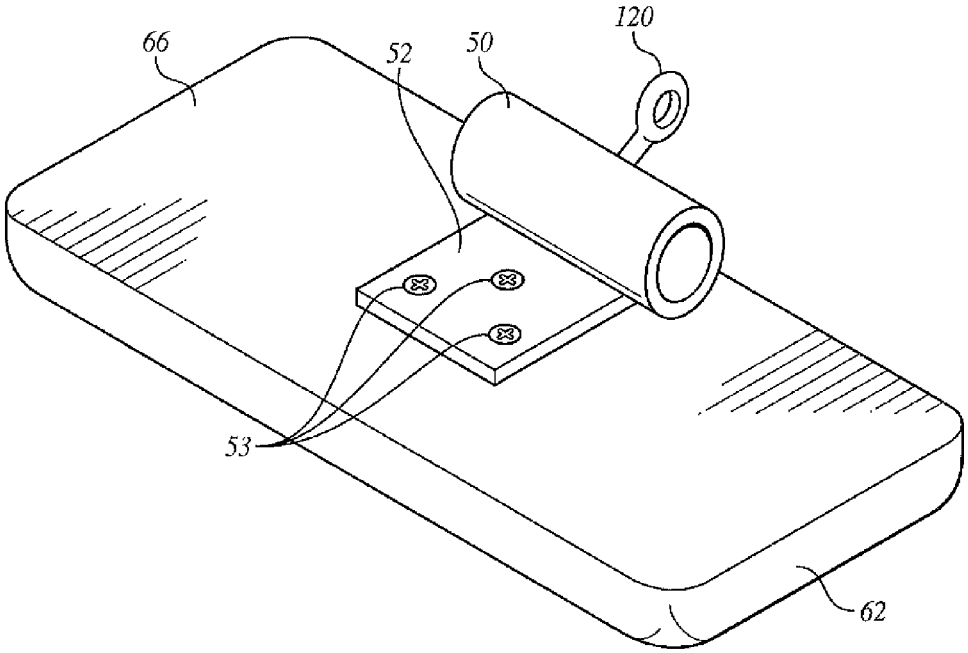
FIG. 8 is a perspective view of the sleeve mounted to the underside of the forearm support platform.

First and second sleeves 50, 51 may include respective mounting brackets 52, 54 for fixedly mounting to the respective undersides 66, 68 of the first and second forearm support platforms 62, 60. As shown, for example in FIG. 8, a sleeve mounting bracket 52 may be secured to an underside 66 of forearm support platform 62 with one or more fasteners 53, for example screws.

Figure 5:
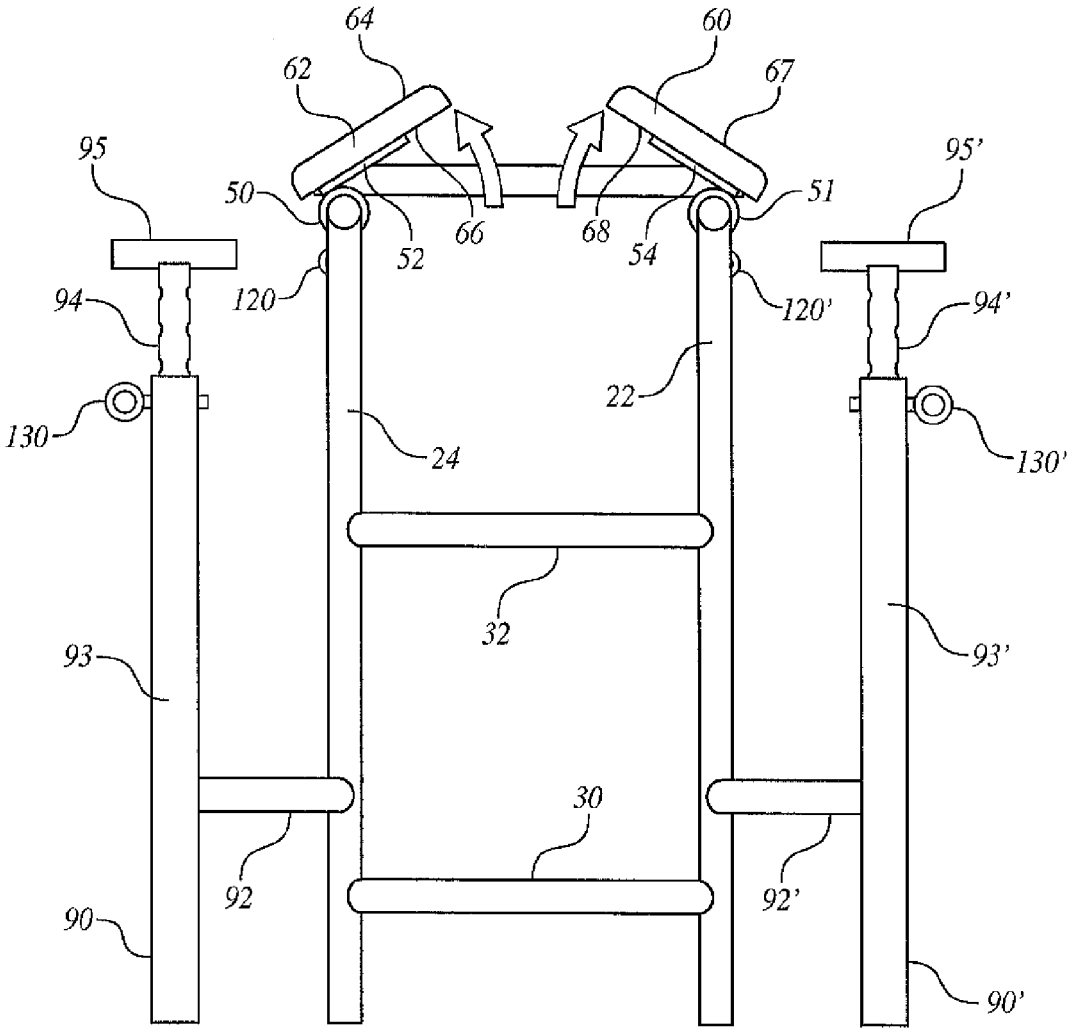
FIG. 5 is a view similar to FIG. 3 but with the forearm support platforms in a raised position.
Figure 6:
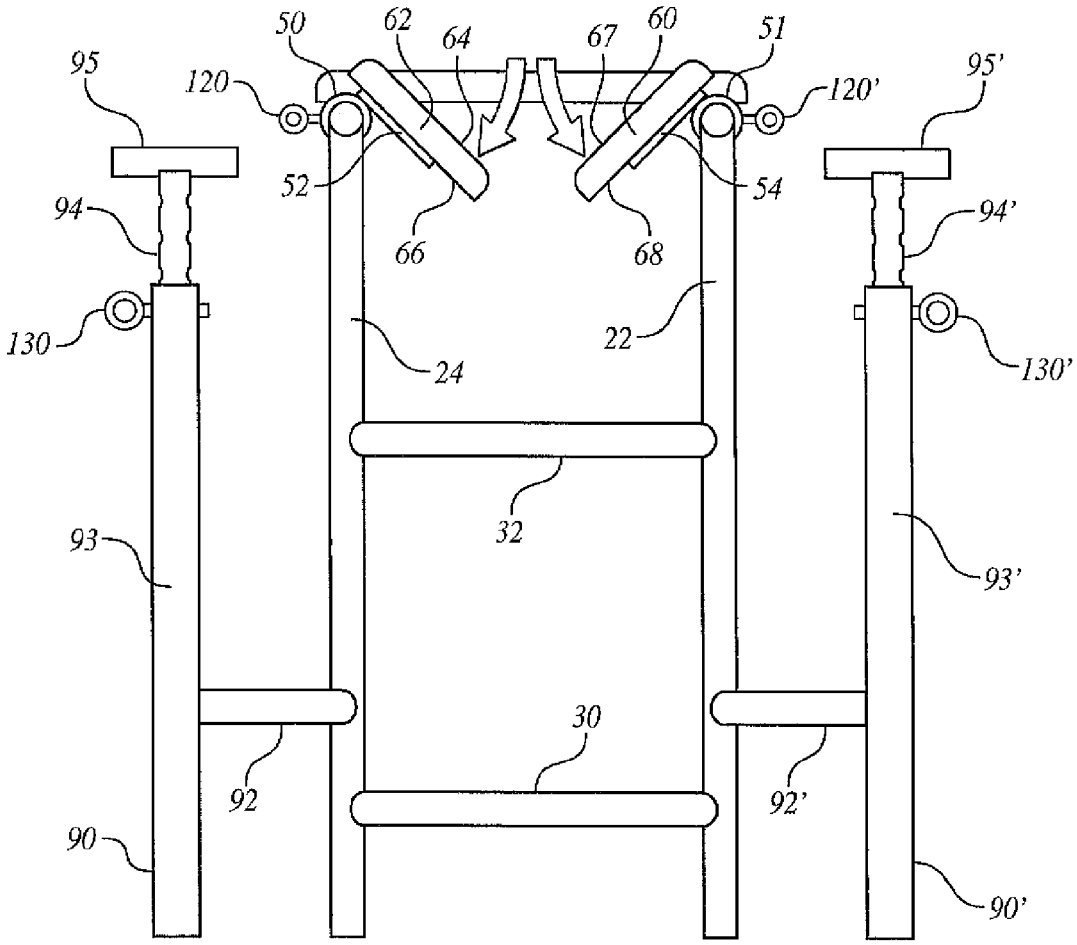
FIG. 6 is a view similar to FIG. 3 but with the forearm support platforms in a lowered position.
Figure 7:
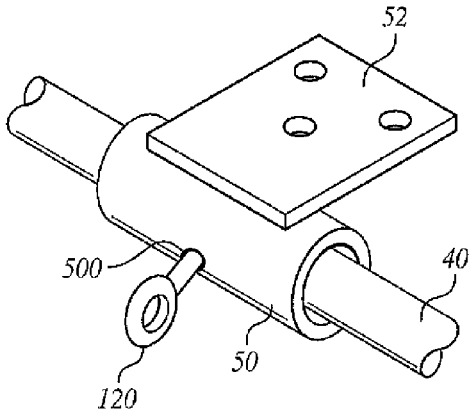
FIG. 7 is a perspective view of a sleeve and forearm support platform attachment bracket, with a round upper longitudinal bar passing through the sleeve.
Figure 9:
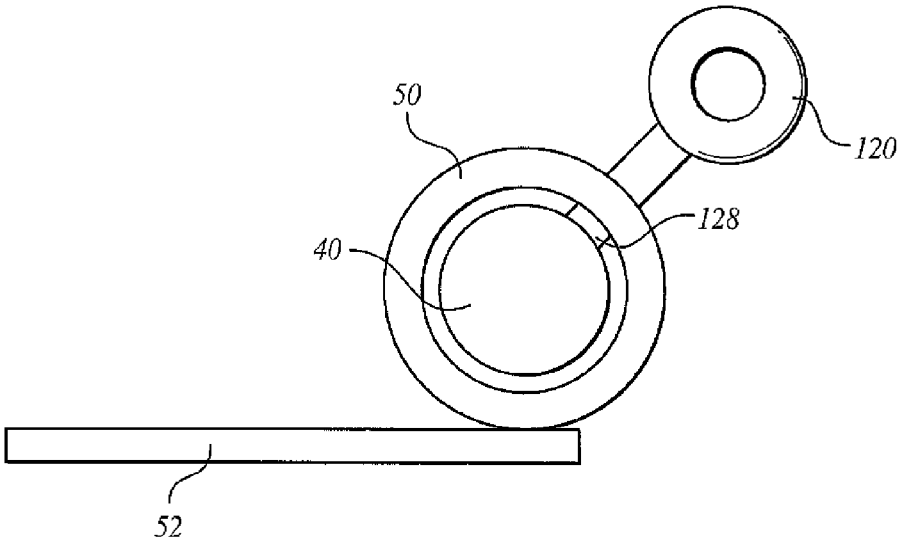
FIG. 9 is a front elevational view of the sleeve with the round upper longitudinal bar passing through the sleeve and a locking pin securing the sleeve to the upper longitudinal bar.

Upper longitudinal bars 40, 42 may be circular in cross section and sized to fit into respective sleeves 50, 51, as shown, for example in FIGS. 7 and 9. Sleeves 50, 51 can rotate about upper longitudinal bars 40, 42 to raise or lower the forearm support platforms 60, 62, as shown in FIGS. 5 and 6. In particular, an angle of first forearm support platform 62 relative to a horizontal plane of the apparatus is adjustable by rotating first sleeve 50 around first upper longitudinal bar 40 and an angle of second forearm support platform 60 relative to the horizontal plane of the apparatus is adjustable by rotating second sleeve 51 around second upper longitudinal bar 42.

Upper longitudinal bars 40, 42 may be comprised of pipes or tubes, for example one half inch steel pipe. Sleeves 50, 51 may be comprised of pipes or tubes, for example three quarter inch steel pipe.

Upon rotating of first sleeve 50 around first upper longitudinal bar 40 in one direction, first forearm support platform 62 is raised, as illustrated in FIG. 5. Rotation of first sleeve 50 in the other direction lowers the forearm support platform 62, as illustrated in FIG. 6. Thus, rotating first sleeve 50 in a counter clockwise direction raises first forearm support platform 62, while rotating in a clockwise direction lowers first forearm support platform 62. The second forearm support platform 60 may be independently raised and lowered in the same manner. With second sleeve 51, rotation in a counterclockwise direction lowers second forearm support platform 60, while rotation in a clockwise direction raises second forearm support platform 60.

Forearm support platforms 60, 62 can be secured in their desired raised or lowered angular positions by means of respective locking pins 120, 120'. A first locking pin 120 is associated with first sleeve 50 and a second locking pin 120' is associated with second sleeve 51. First locking pin 120 is adapted to engage first upper longitudinal bar 40 for locking first forearm support platform 62 in a desired angular position and second locking pin 120' is adapted to engage second upper longitudinal bar 42 for locking second forearm support platform 60 in a desired angular position.

Figure 10:
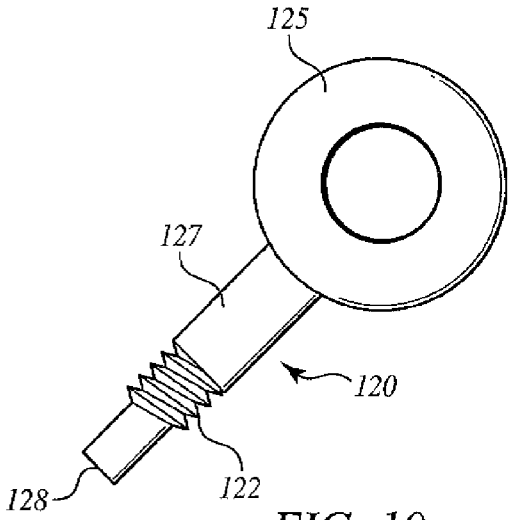
FIG. 10 is a perspective view of the locking pin.

First and second locking pins 120, 120' may be eye hook locking pins. First locking pin 120 may include a grip portion 125, a shank portion 127, and a base portion 128. Shank portion 127 may have a threaded section 122, as shown in FIG. 10. Second locking pin 120' may have a similar structure with a respective grip portion, shank portion, base portion and threaded section.

First sleeve 50 may have a first threaded opening 500 configured to engage the first threaded section 122 of first locking pin 120 (See FIGS. 7, 9, 10). Second sleeve 52 likewise may have a respective threaded opening configured to engage the respective threaded section of second locking pin 120'.

Locking pins 120, 121' are threadably inserted through the respective threaded openings in sleeves 50, 51. The threads in the openings engage the threads of the respective locking pins 120, 120' and the respective base portion of the respective locking pin 120, 120' abuts the respective upper longitudinal bar 40, 42, as shown for first sleeve 50 in FIG. 9. Tightening locking pins 120, 120' in the respective sleeve 50, 51 causes the respective base portion of the respective locking pin to tightly abut respective upper longitudinal bar 40, 42, thereby preventing rotation of the respective sleeve 50, 51 around upper longitudinal bar 40, 42 and locking forearm support platform 62, 60 in place. Loosening or unscrewing the respective locking pin 120, 120' allows rotation of the respective sleeve 50, 51 around the respective upper longitudinal bar 40, 42.

Forearm exercise apparatus 10 further includes a first weight support stanchion 90 coupled to first front vertical support leg 24 and a second weight support stanchion 90' coupled to second front vertical support leg 22. First weight support stanchion 90 may include a first weight support cup 95, a first vertical support member 94 and a first vertical base tube 93. Likewise, second weight support stanchion 90' may include a second weight support cup 95', a second vertical support member 94' and a second vertical base tube 93'. First support cup 95 is disposed at an upper end of first vertical support member 94 and first vertical support member 94 slidably engages first vertical base tube 93. Likewise, second support cup 95' is disposed at an upper end of second vertical support member 94' and second vertical support member 94' slidably engages second vertical base tube 93'.

Vertical support tubes 94, 94' may be telescopically mounted in the respective vertical base tubes 93, 93'. First vertical support tube 94 may have a plurality of spaced-apart through openings 96 for height adjustment of first vertical support tube 94 in vertical base tube 93. First vertical base tube 93 may also have a through opening 98. The second weight support stanchion 90' has a similar arrangement with a plurality of spaced-apart through openings in second vertical support tube 94' and a through opening in second vertical base tube 93'

Height adjustment of first and second weight support stanchions 90, 90' is achieved by raising or lowering vertical support tubes 94, 94' in respective vertical base tubes 93, 93', aligning a pre-selected opening in the vertical support tube 94, 94' with the opening in the vertical base tube 93, 93' and then inserting a respective locking pin 130, 130' through the aligned openings, thereby locking vertical support tube 94, 94' in vertical base tube 93, 93'. In this way, the height of weight bar 100 support cups 95, 95' and therefore, of the weight bar 100 mounted in the weight bar support cups 95, 95' can be vertically adjusted.

Figure 11:
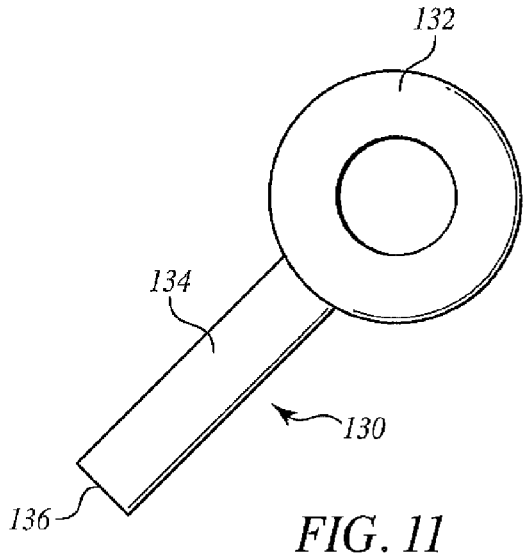
FIG. 11 is a perspective view of a locking pin for a weight support stanchion of the forearm exercise apparatus.

As shown in FIG. 11, first locking pin 130 may include a grip portion 132, a shank portion 134, and a base portion 136. Second locking pin 130' has a similar configurations with a respective grip portion, shank portion and a base portion.

Weight support stanchion 90, 90' may be attached to frame 12 by means of horizontally extending members 92, 92' attached at one end to respective vertical base tubes 93, 93' and at the opposite end to respective front vertical support legs 22, 24, as shown in FIG. 4.

Figure 12:
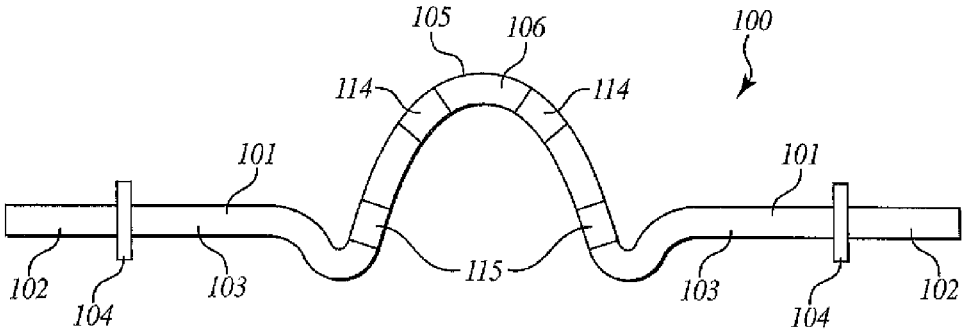
FIG. 12 is a front elevational view of a weight bar for use with the forearm exercise device, wherein the weight bar is in a position for use when the forearm support platforms are in a raised position.
Figure 13:
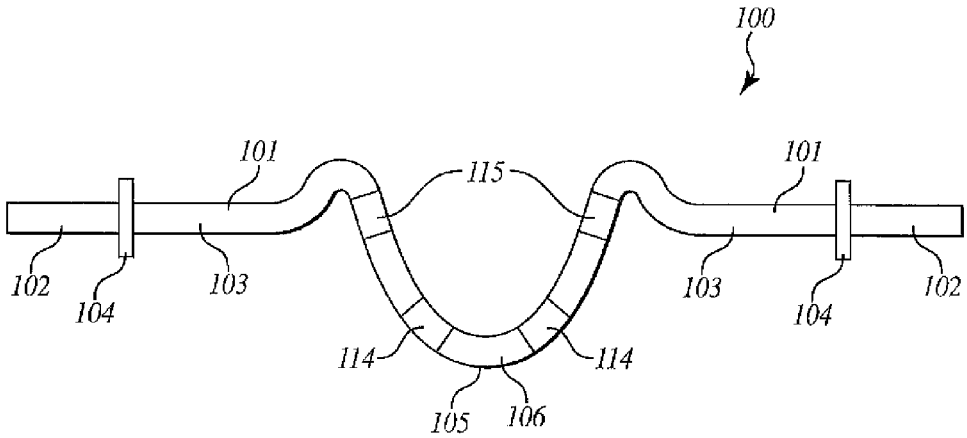
FIG. 13 is a front elevational view of the weight bar in a position for use when the forearm support platforms are in a lowered position.

As shown in FIGS. 12 and 13, a weight bar 100 for use with a forearm exercise apparatus according to an aspect of the invention may include two outer bars 101 separated by a central curved portion 105. The two outer bars 101 include two sections, an outer weight holding section 102 and an inner mounting section 103. Sections 102 and 103 are separated by a weight stop 104 which prevents the weights from moving inwardly.

The outer weight holding sections 102 accept the weights, while the inner mounting sections 103 fit into and rest in the weight support or weight bar support cups 95, 95'. The central curved or arcuate portion 105 of weight bar 100 is comprised of a top curved section 106 and two lower curved sections on either side of top curved section 106. Top curved section 106 extends upwardly while the two lower curved sections extend downwardly as shown in FIG. 12.

When the forearm support platforms 60, 62 are in a raised position, as shown in FIG. 5, and the weight bar 100 is in the position shown in FIG. 12, the user's hands grip sections 114 of the central curved section 105 of the weight bar 100. When the forearm support platforms 60, 62 are in the lowered position, as shown in FIG. 6, and the weight bar 100 is in the position shown in FIG. 13, the user's hands grip sections 115 of the central curved section 105 of the weight bar 100.

The provision of pivoting forearm support platforms 60, 62, which are adjustable from a raised position to a lowered position results in a user being able to develop forearm muscles on both sides of the forearm, the outside or outer forearm and the inside or inner forearm, without risking injuring or damaging the wrist which is subject to great pressure and strain during this exercise. When the forearm support platforms 60, 62 are in a raised position, the outside extensor forearm muscles are developed. When the forearm support platforms 60, 62 are in a lowered position, the inside flexor forearm muscles are developed. Moreover, the forearm support platforms can be adjusted to the exact angle of natural wrist movement.

While a number of embodiments of the present invention have been shown and described, it is obvious that many changes and modifications may be made thereunto without departing from the spirit and scope of the invention.

What is claimed is:

1. A forearm exercise apparatus comprising:

a) a frame comprising:

a first rear vertical support leg;

a second rear vertical support leg;

a first front vertical support leg;

a second front vertical support leg;

a first upper longitudinal bar coupling said first rear vertical support leg to said first front vertical support leg; and a second upper longitudinal bar coupling said second rear vertical support leg to said second front vertical support leg;

b) a seat platform disposed over said first upper longitudinal bar and said second upper longitudinal bar; and c) a pair of pivoting forearm support platforms disposed in front of said seat platform, said pair of pivoting forearm support platforms comprising;

a first forearm support platform having a first sleeve disposed on an underside of said first forearm support platform, wherein said first upper longitudinal bar passes through said first sleeve; and a second forearm support platform having a second sleeve disposed on an underside of said second forearm support platform, wherein said second upper longitudinal bar passes through said second sleeve;

wherein an angle of said first forearm support platform relative to a horizontal plane of the apparatus is adjustable by rotating said first sleeve around said first upper longitudinal bar and an angle of said second forearm support platform relative to the horizontal plane of the apparatus is adjustable by rotating said second sleeve around said second upper longitudinal bar.

2. The forearm exercise apparatus according to claim 1, further comprising a first locking pin associated with said first sleeve and a second locking pin associated with said second sleeve.

3. The forearm exercise apparatus according to claim 2, wherein said first locking pin is adapted to engage said first upper longitudinal bar for locking said first forearm support platform in a desired angular position and said second locking pin is adapted to engage said second upper longitudinal bar for locking said second forearm support platform in a desired angular position.

4. The forearm exercise apparatus according to claim 3, wherein said first locking pin comprises a first grip portion, a first shank portion, a first threaded section and a first base portion and said second locking pin comprises a second grip portion, a second shank portion, a second threaded section and a second base portion.

5. The forearm exercise apparatus according to claim 4, where said first sleeve comprises a first threaded opening configured to engage said first threaded section of said first locking pin and said second sleeve comprises a second threaded opening configured to engage said second threaded section of said second locking pin.

6. The forearm exercise apparatus according to claim 1, further comprising a first weight support stanchion coupled to said first front vertical support leg and a second weight support stanchion coupled to said second front vertical support leg.

7. The forearm exercise apparatus according to claim 6, wherein first weight support stanchion comprises a first weight support cup, a first vertical support member and a first vertical base tube and said second weight support stanchion comprises a second weight support cup, a second vertical support member and a second vertical base tube.

8. The forearm exercise apparatus according to claim 7, wherein said first support cup is disposed at an upper end of said first vertical support member, said first vertical support member slidably engages said first vertical base tube, said second support cup is disposed at an upper end of said second vertical support member and said second vertical support member slidably engages said second vertical base tube.

9. The forearm exercise apparatus according to claim 8, further comprising a first locking pin associated with said first weight support stanchion and a second locking pin associated with said second weight support stanchion.

10. The forearm exercise apparatus according to claim 9, wherein, said first vertical support member has a plurality of first spaced apart through openings;

said first vertical base tube has a first through opening;

said second vertical support member has a plurality of second spaced apart through openings;

said second vertical base tube has a second through opening;

said first locking pin is configured to be inserted through said first through opening of said first vertical base tube and a selected through opening of said plurality of first spaced apart through openings; and said second locking pin is configured to be inserted through said second through opening of said second vertical base tube and a selected through opening of said plurality of second spaced apart through openings.

* * * * *